US007446463B2

(12) United States Patent
Döll et al.

(10) Patent No.: US 7,446,463 B2
(45) Date of Patent: Nov. 4, 2008

(54) SOLDER-FREE CONTACT-MAKING OF DIELECTRICALLY IMPEDED DISCHARGE LAMPS

(75) Inventors: Gerhard Döll, Guangzhou (CN); Jörg Otterstätter, Gerstetten (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 454 days.

(21) Appl. No.: 11/185,940

(22) Filed: Jul. 21, 2005

(65) Prior Publication Data

US 2006/0028142 A1 Feb. 9, 2006

(30) Foreign Application Priority Data

Aug. 6, 2004 (DE) ..... 10 2004 038 346

(51) Int. Cl.
*H01J 1/62* (2006.01)

(52) U.S. Cl. ..... 313/493; 313/634; 313/234

(58) Field of Classification Search ..... 313/493, 313/422, 634, 607, 484–485, 514–515, 519, 313/491, 483, 475, 473, 56, 169.4, 627–643, 313/567, 111–117, 25–27, 318.01–318.09; 439/615, 739; 445/24, 26, 29, 22
See application file for complete search history.

(56) References Cited

U.S. PATENT DOCUMENTS 6,075,318 A * 6/2000 Noll et al. ..... 313/573
6,099,144 A * 8/2000 Klaus ..... 362/263
6,642,640 B1 11/2003 Helbig et al.
2002/0163312 A1* 11/2002 Kling et al. ..... 315/56
2003/0111960 A1 6/2003 Doll et al.
2004/0183467 A1* 9/2004 Bschorer ..... 315/246
2005/0088098 A1* 4/2005 Reich et al. ..... 313/634

FOREIGN PATENT DOCUMENTS

| | | |
|---|---|---|
| JP | 09-259826 | 10/1997 |
| JP | 2000-011961 | 1/2000 |
| JP | 2001-307682 | 11/2001 |
| JP | 2003-257377 | 9/2003 |
| WO | WO 01/31670 | 5/2001 |

* cited by examiner

*Primary Examiner*—Mariceli Santiago
*Assistant Examiner*—Donald L Raleigh
(74) *Attorney, Agent, or Firm*—Robert F. Clark

(57) ABSTRACT

The invention relates to contact-making of dielectrically impeded discharge lamps by means of a mechanical procedure with plastic deformation of a contact surface 17. It is thus possible to dispense with thermal steps such as soldered connections or welded connections and to therefore make savings in terms of time and on the complexity of the apparatus used.

6 Claims, 3 Drawing Sheets

G-G

SOLDER-FREE CONTACT-MAKING OF DIELECTRICALLY IMPEDED DISCHARGE LAMPS

TECHNICAL FIELD

The present invention relates to a method for making contact with a dielectrically impeded discharge lamp and to a lamp with which contact has correspondingly been made.

BACKGROUND ART

Dielectrically impeded discharge lamps are known per se and in the meantime have been extensively documented in the prior art. They are characterized by the fact that at least part of the discharge electrodes is isolated from a discharge medium in the discharge space of the lamp by a dielectric; in the unipolar case, this is the anodes and, in the bipolar case, this is consequently all of the discharge electrodes.

Dielectrically impeded discharge lamps have excellent switching strength owing to their long life and various application possibilities which are already successful and are very promising for the future owing to the degrees of geometric freedom in the design of the discharge vessel. Above all in connection with a pulsed mode of operation, which is documented in the prior art, for such dielectrically impeded discharge lamps, extremely good efficiency values can also be achieved.

Application areas which are of importance today are office automation, in particular linear lamps for scanners, fax machines and similar appliances, and large-area flat lamps, so-called flat radiators, for backlighting monitors and other graphical displays. However, the invention is not restricted to these application areas. Rather, there are other application sectors, for example in UV treatment in trade and industry, in general lighting, in luminaire design etc. Other application possibilities may be developed in the future.

The discharge electrodes of a dielectrically impeded discharge lamp need to be electrically connected to outer lines, i.e. contact needs to be made between them. In this case, metallic conductor tracks, which are connected to the electrodes or form an extension of the electrodes, are often led up to a contact surface on which an outer incoming line, i.e. a cable, a contact pin or the like, is soldered. In the case of inner electrodes, the mentioned conductor tracks are in this case passed through a discharge vessel wall in a gas-tight manner, and the soldered contacts are performed externally.

DISCLOSURE OF THE INVENTION

The present invention is based on the technical problem of specifying a dielectrically impeded discharge lamp which is improved in terms of the contact-making of the discharge electrodes and a corresponding method for making contact with a dielectrically impeded discharge lamp.

The invention firstly relates to a dielectrically impeded discharge lamp having a discharge vessel and having discharge electrodes which are at least partially isolated from a discharge medium in the discharge vessel by a dielectric layer, and having a contact surface for the purpose of making electrical contact with discharge electrodes, which is attached externally in relation to the discharge vessel, and a line which is attached to the contact surface for contact-making purposes, the line being attached to the contact surface whilst plastically deforming the contact surface in the fixed state.

Secondly, the invention relates to a method for making contact with a dielectrically impeded discharge lamp having a discharge vessel and having discharge electrodes which are at least partially isolated from a discharge medium in the discharge vessel by a dielectric layer, and having a contact surface for the purpose of making electrical contact with discharge electrodes, which is attached externally on the lamp in relation to the discharge vessel, the line being brought into connection with the contact surface whilst plastically deforming the contact surface in the fixed state.

The basic concept of the invention consists in producing the electrical contact without in the process thermally fusing the metallic material of the contact surface and/or of the part of the line in touching contact with said contact surface. The invention is thus intended to offer an alternative to conventional soldering processes or welding processes. Instead, an electrically highly conductive contact is intended to be produced by plastically deforming at least the contact surface and optionally also that part of the line itself which is in touching contact, the respective materials not being thermally fused in the process. They should therefore remain in a solid aggregate state, i.e. to be more precise in any case they should be fused to a microscopic degree owing to the effects of friction. However, in the process "flowing" of metallic material during the plastic deformation is not ruled out. In addition, as will be explained in more detail further below, the additional use of liquid, conductive materials is not ruled out as long as there is no soldering process, i.e. addition of a thermally fused metal. One example is (even conductive) adhesive materials which also ensure that contact is made according to the invention and can also further improve conductivity.

The invention therefore relates in particular to contact-making by means of a "cold" pressing-in or cutting-in of the line part which is in touching contact into the contact surface, or vice versa.

One advantage of the invention consists in the fact that savings can be made in terms of processing time and thus costs as compared with soldering and welding processes, since the contacts according to the invention can be produced relatively quickly and (apart from, for example, additional conductive adhesive material) purely mechanically. The soldering processes which are introduced for the dielectrically impeded discharge lamps considered here require relatively extensive heating, however. Since the contact surface is often attached to other lamp parts having a notable thermal capacity, for example on glass walls of the discharge vessel, the conventional soldering processes are associated with considerable heating and cooling times. Furthermore, it may be advantageous to dispense with a heating step owing to the interaction with other lamp parts or process steps. Finally, the complexity in terms of apparatus is less since it can be restricted to mechanical manipulation.

The part of the line in touching contact with the contact surface, i.e. a contact pin of a lampholder or a lamp base, a piece of wire which is attached to a cable end or the like, is preferably in the form of a hook. The hook shape firstly has the advantage of a spring effect owing to the geometry which may be useful for the plastic deformation when pressure is applied. Secondly, the hook-shaped part, referred to below as a hook for short, can be clamped fixedly and/or hooked effectively owing to this spring effect, if required. The elasticity of the contact hooks also has the advantage of being able to effectively compensate for dimensional tolerances.

In particular, the limb of the hook which is adjacent to the contact surface can be used for contact-making purposes and can protrude from the contact surface at an acute angle once contact has been made. The free end of this limb in the process "scrapes" over the contact surface when the contact is made or digs into it with plastic deformation, in particular when there is a movement in the direction of the limb, i.e. in the form of a barb. For illustration purposes, reference is made to the exemplary embodiment.

Preferred materials for the hook or generally the part in touching contact of the line with which contact has been made are medium-hard to spring-hard alloys, in particular Cu alloys.

In a further preferred embodiment, a plastic support is provided for the hook, for example a silicone tube piece. This plastic support may also have insulating functions, for example in order to prevent surface discharges or flashovers. In addition, the support may considerably simplify manipulation of the hook or else a plurality of hooks and assist in their elastic properties.

However, this is in particular also the case not only when the hook or hooks, as is likewise preferred in this invention, is(are) pushed in between clamping walls of the lamp for fixing purposes. The clamping firstly achieves fixing of the hook and secondly production of a pressure force for the plastic deformation in the case of contact-making itself. The hook(s) can in this case be clamped in together with the plastic support.

In place of the plastic support which can be manipulated as early as when it is assembled, the hook(s) may also be cast or adhesively bonded after the plastic deformation.

If that part of the line which is used for contact-making-purposes, in particular a hook part, bears directly against an exhaust tube or another part of the discharge vessel, a favorable combination effect can be achieved by this part at the same time acting as an auxiliary starting electrode. In order to illustrate this, reference is made to the exemplary embodiment and to the disclosure content of U.S. 2003/0111960 A1 which is illustrative also as regards other aspects of the invention.

This prior art also illustrates a further preferred aspect of the present invention, namely that the contact surface is attached to an inner surface of a protruding wall part of the discharge vessel, in particular to a protruding tube section.

It is furthermore preferred for the hook or another part of the line which is used for contact-making purposes to have a metal edge which is pointed or round or in any case convexly shaped and with which the part digs into the contact surface when contact is made.

The invention primarily relates to lamps which have a discharge vessel which is elongate in the form of a tube. In particular, the mentioned clamping walls may be, on one side, a protruding tube section of the discharge vessel and, on the other side, the exhaust tube of the discharge vessel, which enclose an annular gap between them in which the hook is clamped. In this case, a further line, with a hook-shaped part clamped in the annular gap, is preferably attached to a contact surface, and the two hooks and the two contact surfaces are provided in relation to the annular gap at positions which are offset in the circumferential direction.

As mentioned, the invention also relates to a method for making contact with a dielectrically impeded discharge lamp, the described features also being understood as method features. In particular, the line may have a hook which is attached to the contact surface, and the hook can be brought into connection with the contact surface bringing about a displacement in relation to the contact surface which deforms the contact surface. As an alternative or in addition, the dielectrically impeded discharge lamp may have a discharge vessel which is elongate in the form of a tube, and the hook may be brought into connection with the contact surface bringing about a rotation around the longitudinal axis of the discharge vessel in relation to the contact surface which deforms the contact surface. In the case of a rotational movement and/or in the case of an insertion movement, the contacts or the conductor may also be fixed in a latching manner, for example, for this purpose.

BRIEF DESCRIPTION OF THE DRAWINGS

An exemplary embodiment of the invention is explained below, it being possible for the disclosed features also to be essential to the invention in other combinations, and the disclosed features as well as the features in the description above also relating implicitly both to the apparatus aspect and to the method aspect of the invention.

BEST MODE FOR CARRYING OUT THE INVENTION

Figure 1:
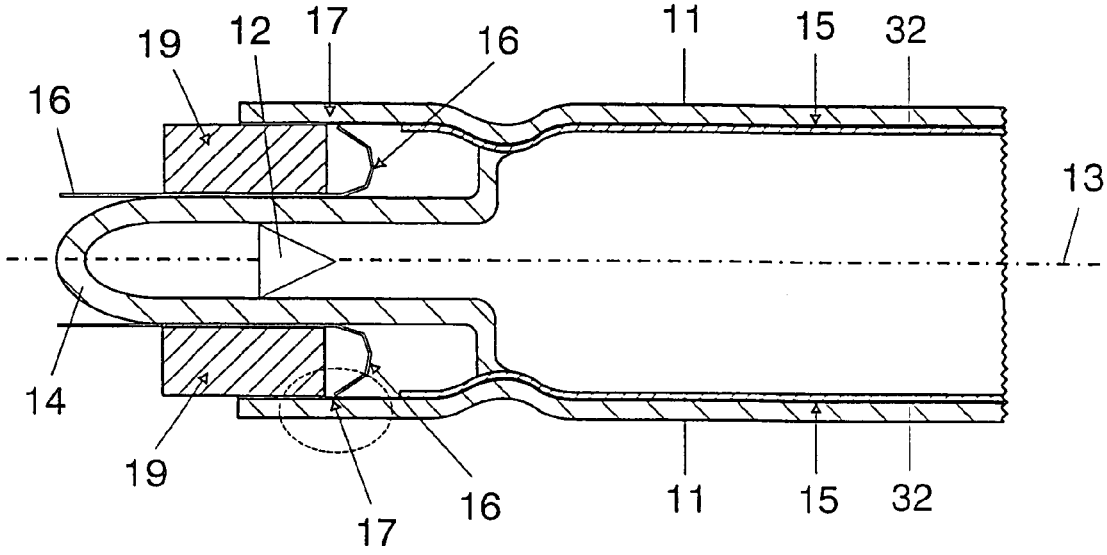
FIG. 1 shows a schematic sectional view of a first exemplary embodiment of a part of a dielectrically impeded discharge lamp according to the invention with which contact has been made.

FIG. 1 shows a sectional view of a part of a lamp according to the invention with which contact has been made. Of concern here is the left-hand end (as shown in FIG. 1) of a tubular dielectrically impeded discharge lamp of the LINEX type for scanning and copying applications. For further illustrative purposes, reference is made to the above-cited prior art U.S. 2003/0111960 A1, in which this lamp is explained in detail apart from the contact-making which is the subject of the invention here.

A tubular discharge vessel 11 contains a discharge medium (not provided with a reference), a so-called starting pad 12, which is explained in more detail in the cited prior art and rests on the inside of an exhaust tube 14 of the discharge vessel 11. In a manner which is conventional per se, discharge electrodes 15 having a dielectric layer 32 are attached to the inner surfaces of the outer shield of the discharge vessel 11 using silver paste, said discharge electrodes 15 being passed through a disk lid, which seals off the discharge vessel 11 at the attachment of the exhaust tube 14, in a gas-tight manner. The outermost ends (i.e. the left-hand ones in FIG. 1) of the electrodes 15 run out into contact surfaces (denoted 17) which could conventionally be used as solder pads. These ends are slightly wider and thicker than the electrodes 15, but are also made of silver paste, i.e. were spread-coated as a viscous suspension and then dried and baked by means of a thermal treatment. The contact surface 17 can be seen more clearly again in the schematic FIG. 4. This FIG. 4 corresponds to a larger illustration of the region encircled on the left-hand side at the bottom in FIG. 1.

A plastic support 19, namely a silicone tube piece, is pushed in with a precise fit into an annular gap between a protruding section of the discharge vessel 11 on the outside and the exhaust tube 14 on the inside, which annular gap is accessible from the left in FIG. 1 and is rotationally symmetrical about the longitudinal axis 13. The silicone tube piece supports wire hooks 16 made from a medium-hard to spring-hard Cu alloy, for example Wieland L 49 (in accordance with DIN 17664: CuNi9Sn2, UNS: C 72500).

The spring hooks 16 are supported with a straight piece which bears against the exhaust tube 14 by means of the plastic support 19 on the exhaust tube 14 and are connected to a cable line to the left of this in a manner which is not illustrated in FIG. 1. A piece which protrudes to the right in FIG. 1 beyond the plastic support 19, is bent back to the outside and forms a limb which is in touching contact with the contact surface 17 at an acute angle.

Figure 4:
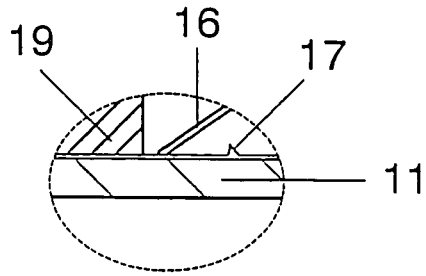
FIG. 4 shows a schematic illustration of the detail which is encircled in FIG. 1 for the purpose of illustrating the invention.

The details of the touching contact are illustrated in more detail in FIG. 4. The plastic support 19 is pushed into the abovementioned gap with the hooks 16 from the left, it being possible for the hooks 16 to give elastically owing to their hook shape. The hooks are then supported by the plastic support 19 on the exhaust tube 14 and are displaced to the right along the contact surfaces 17 parallel to the longitudinal axis 13.

Figure 2:
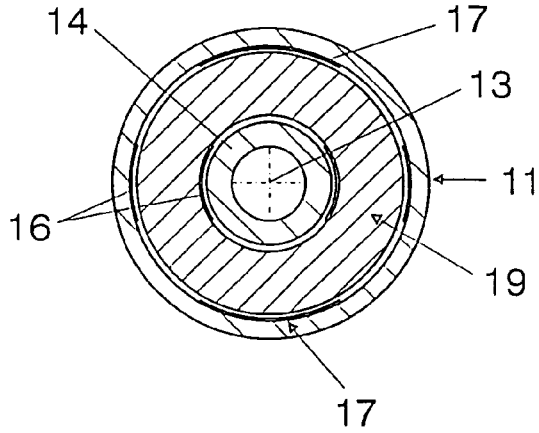
FIG. 2 shows a section through the lamp shown in FIG. 1 in a first position during contact-making.

The further procedure is explained with reference to FIGS. 2 to 4. FIG. 2 shows a sectional view transverse with respect to the longitudinal axis 13. The outermost ring in FIG. 2 is the protruding section of the discharge vessel 11, the ring which is drawn within this ring is the plastic support 19, and the inner ring is the exhaust tube 14. FIG. 2 shows the situation which arises when the plastic support 19 is pushed into the annular gap. In this case, namely the sections through the hooks 16 in FIG. 2 are still horizontal on the left and on the right, the contact surfaces 17 being oriented upwards and downwards, i.e. vertically.

Figure 3:
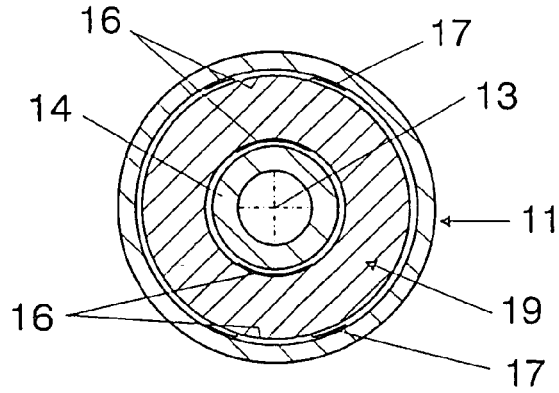
FIG. 3 shows a section, which corresponds to FIG. 2, through the lamp shown in FIG. 1 in a second position during contact-making.

FIG. 3, which is a corresponding section, shows the hooks 16 rotated through 90° with respect to FIG. 2, with the result that said hooks come to rest on the contact surfaces 17 with their outermost ends. In turn, FIG. 4 shows schematically the detail encircled in FIG. 1, namely an outermost end of a contact hook 16 on a contact surface 17 which is attached to the inner side of the protruding section of the discharge vessel 11. This figure shows schematically that an outer edge of the hook 16 has cut into the silver contact surface 17, to be precise as a result of the rotation illustrated in FIGS. 2 and 3. In addition, the plastic support 19 together with the hooks 16 or the hooks 16 themselves may still be pulled back slightly axially, i.e. towards the left in FIG. 1 and FIG. 4, such that the hooks 16 "hook" better still in the contact surface 17, i.e. dig into the silver layer. In this case, FIG. 4 attempts to illustrate that pressing-in can result in a proper interlocking connection. Pressure forces of approximately 30-35 N have proved successful here.

Depending on the constitution of the silver layer and on the force applied, in this case it is also possible for the contact surface to be subjected to damage which is actually not problematic. If contacts are used which are particularly severely hooked and cut-in, in this case substantial scrapings are tolerated. If more value is placed on a solution which is thoroughly possible in the context of the invention and which thus also has its own advantages and in which the contact can be released and reused, more care should be taken, if possible.

Figure 5:
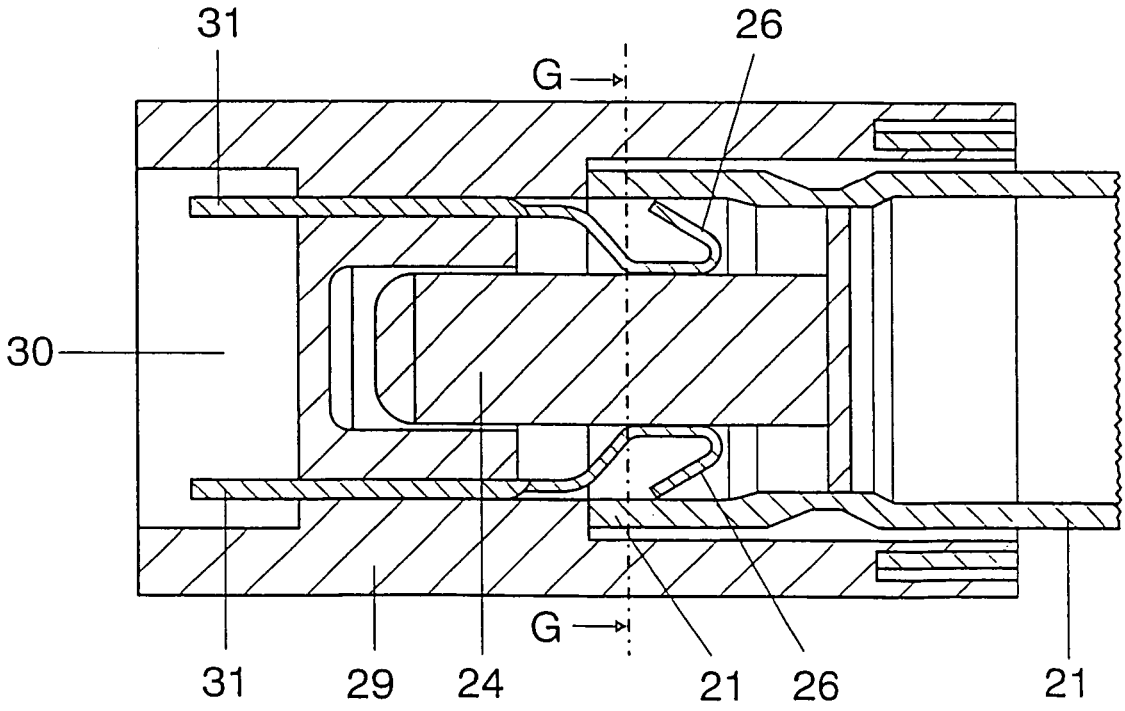
FIG. 5 shows a detail which corresponds to FIG. 1 in perspective of a second exemplary embodiment of a lamp according to the invention including part of a base.

FIGS. 5 to 8 show a second exemplary embodiment of the invention. This second exemplary embodiment is a likewise tubular dielectrically impeded discharge lamp, but having an actual lamp base, one part of which (the left-hand part in the figures) is illustrated in FIG. 5. Corresponding parts are given reference numerals in each case increased by 10. FIG. 5 also shows a sectional illustration corresponding to FIG. 1.

A tubular gas discharge vessel which continues to run towards the right is denoted 21 and ends in a hole in a base which is denoted 29, overall. The base 29 in this case also accommodates an exhaust tube 24 which in this case protrudes slightly beyond the protruding section of the discharge vessel 21. The opposite left-hand side of the base 29 has a plug connection socket 30 having contact pins 31. The contact pins 31 are straight extensions of a hook-shaped contact element (denoted 26 in the right-hand region) which will be explained in more detail in FIGS. 6 to 8. This contact hook 26 (as in FIG. 1) bears partially against the exhaust tube 24, but in this case without a plastic support in the sense of the support 19 shown in FIG. 1, and is bent back at an angle starting from this exhaust tube 24 in order for its outermost end to reach a contact surface (not illustrated) on the inner side of the protruding section of the discharge vessel 21. Here, an angle of 32° with respect to the longitudinal axis results (as shown in FIG. 5).

Figure 6:
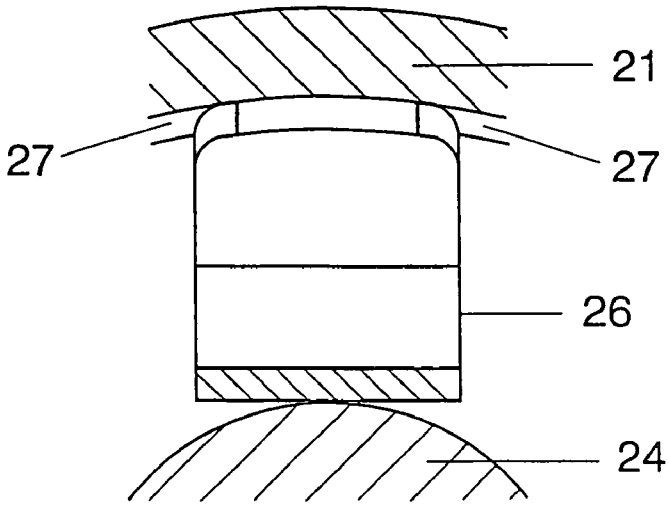
FIG. 6 shows a detail of the section G-G sketched in FIG. 5.

FIG. 5 shows the orientation and plane of the section G-G illustrated in FIG. 6. A lower section, which bears against the exhaust tube 24, through the contact hook 26 and the upper end which bears against and is pushed into the contact surface (denoted 27 here) can be seen in this figure.

Figure 7:
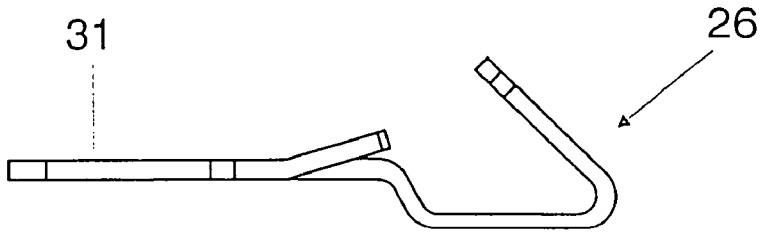
FIG. 7 shows a contact hook corresponding to FIG. 5 as an individual illustration.
Figure 8:
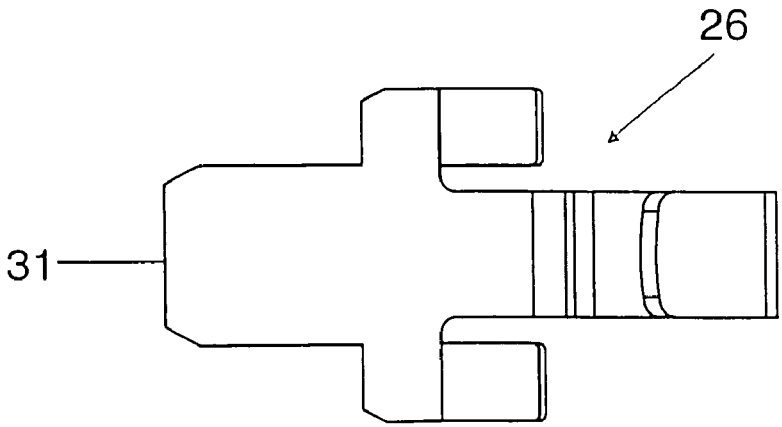
FIG. 8 shows the contact hook shown in FIG. 7 in plan view.

FIGS. 7 and 8 show one of the two contact hooks 26 shown in FIG. 5 in a side view which corresponds to that in FIG. 5 and in plan view. The angle illustrated in FIG. 5 at 32° is in this case 45°, the difference of 13° being the result of the contact hook 26 being pressed into the annular gap (already mentioned with reference to FIG. 1) between the protruding section of the discharge vessel and the exhaust tube, as will be explained below. Moreover, the contact hook 26 in FIGS. 5, 7 and 8 runs out towards the left to form a straight piece which forms one of the contact pins 31 shown in FIG. 5. Otherwise, that straight part of the contact hook which runs out into this contact pin 31 bears two lateral clamping plates which can be seen at the top and bottom in FIG. 8 and which (as shown in FIG. 7) are slightly bent up. These clamping plates serve the purpose of fixing the contact hook 26 once it has been pressed into correspondingly preshaped slots in the base 29 shown in FIG. 5. The base 29 is in this case a plastic injection molded part in which the corresponding contact plates can dig in effectively.

The base 29 is preassembled with the two contact hooks 26 and is then pushed onto the discharge vessel 21 from the left (in the orientation in FIG. 5), the contact hooks 26 penetrating the abovementioned annular gap. Then, the rotation which has already been explained with reference to FIGS. 2 and 3 takes place. If required, the base may be pulled back slightly in order to allow the contact hook 26 to cut into the contact surface 27 even more effectively. In addition, the cavity which can be seen in FIG. 5 around the contact hooks 26 can be filled with silicone in order to provide the mechanical connection and for reasons of electrical insulation.

The base 29 thus fulfills a function as regards support which corresponds to the much simpler plastic support 19 shown in FIG. 1. A device-side plug can be pushed directly into the plug connection socket 30 provided in said base 29, as a result of which the discharge lamp is completely connected.

The exemplary embodiments show that a lamp according to the invention having contacts which have already been produced in the manner according to the invention is delivered and only the lines or contact pins with which contact has been made in this way are connected to a lampholder, an electronic device or the like. The lamp with which contact has been made is available in other embodiments but, if possible, is only available when it has been incorporated in a lampholder or a device and the contacts have been made.

What is claimed is:

1. A dielectric barrier discharge lamp, comprising:

an elongated, tubular discharge vessel having a longitudinal axis and containing a discharge medium and discharge electrodes which are at least partially isolated from the discharge medium in the discharge vessel by a dielectric layer;

a protruding tube section extending outwardly from an end of the discharge vessel, the protruding tube section having contact surfaces external to the discharge vessel and electrically connected to the discharge electrodes, the contact surfaces being disposed on an inner surface of the protruding tube section;

an exhaust tube concentric with the protruding tube section, the protruding tube section and exhaust tube defining an annular gap that is rotationally symmetrical about the longitudinal axis; and electrically conductive spring hooks inserted into the annular gap, the hooks having a straight piece that bears against the exhaust tube and an outermost end that bears against one of the contact surfaces to form a solder-free electrical connection.

2. The lamp of claim 1 further comprising a plastic support having a precise fit to the annular gap between the protruding tube section and the exhaust tube, the plastic section being pushed into the annular gap to secure the spring hooks against the exhaust tube.

3. The lamp of claim 2 wherein the plastic support is a silicone tube piece.

4. The lamp of claim 1 further comprising a base wherein the spring hooks are fixed in the base.

5. The lamp of claim 1 wherein the contact surfaces are comprised of silver and the outermost ends of the spring hooks dig into the silver contact surfaces.

6. The lamp of claim 4 wherein the spring hooks are brought into contact with the contact surfaces by rotating the base about the longitudinal axis.

* * * * *